US008365490B2

(12) United States Patent
Kinzler

(10) Patent No.: US 8,365,490 B2
(45) Date of Patent: Feb. 5, 2013

(54) PURLIN CLIP FOR BLOWN-IN INSULATED CEILINGS

(75) Inventor: Kevin W. Kinzler, Ames, IA (US)

(73) Assignee: HIDH-R, Inc., Ames, IA (US)

( * ) Notice: Subject to any disclaimer, the term of this patent is extended or adjusted under 35 U.S.C. 154(b) by 162 days.

(21) Appl. No.: 12/853,335

(22) Filed: Aug. 10, 2010

(65) Prior Publication Data

US 2012/0036808 A1 Feb. 16, 2012

(51) Int. Cl.

| | |
|---|---|
| ***E04B 9/00*** | (2006.01) |
| ***E04B 1/74*** | (2006.01) |
| ***E04B 5/00*** | (2006.01) |
| ***E04B 1/38*** | (2006.01) |

(52) U.S. Cl. ..... 52/361; 52/404.2; 52/404.3; 52/408; 52/512

(58) Field of Classification Search ..... 52/404.1, 52/404.2, 404.3, 404.5, 408, 410, 512, 506.01, 52/506.05, 506.06, 361, 700, 712; 411/396, 411/480

See application file for complete search history.

(56) References Cited

U.S. PATENT DOCUMENTS

| | | | | |
|---|---|---|---|---|
| 2,353,579 | A * | 7/1944 | Miller | 411/447 |
| 2,878,905 | A * | 3/1959 | Langermeier | 403/11 |
| 3,362,280 | A * | 1/1968 | Muller | 411/373 |
| 3,983,779 | A * | 10/1976 | Dimas | 411/447 |
| 4,030,261 | A * | 6/1977 | Coleman | 52/511 |
| 4,069,738 | A * | 1/1978 | McClure | 411/34 |
| 4,333,292 | A * | 6/1982 | Musgrave | 52/404.2 |
| 4,649,689 | A * | 3/1987 | Everman et al. | 52/701 |
| 5,518,215 | A * | 5/1996 | Lyons | 248/309.2 |
| 6,324,808 | B1 | 12/2001 | Lippy et al. | |
| 6,330,779 | B1 | 12/2001 | Kinzler | |
| 6,385,935 | B2 * | 5/2002 | Lippy | 52/512 |
| 7,107,732 | B2 * | 9/2006 | Kinzler | 52/404.5 |
| 2001/0015041 | A1 * | 8/2001 | Lippy | 52/512 |

* cited by examiner

*Primary Examiner* — Joshua J Michener
*Assistant Examiner* — Ryan Kwiecinski
(74) *Attorney, Agent, or Firm* — McKee, Voorhees & Sease, P.L.C.

(57) ABSTRACT

An improved purlin clip has an arm and a leg defining a channel to receive the lower flange of a ceiling purlin. A pin is integrally formed with the lower leg of the clip and extends downwardly. The pin is adapted to penetrate a ceiling membrane. A cap is frictionally fit onto the pin to retain the membrane adjacent the purlin, and to support the membrane, with the insulation blown in between the membrane and the ceiling deck. The pin includes teeth or barbs for retentively engaging the cap.

18 Claims, 4 Drawing Sheets

PURLIN CLIP FOR BLOWN-IN INSULATED CEILINGS

BACKGROUND OF THE INVENTION

Metal buildings are popular due to the relatively quick construction and low cost, as well as low maintenance. However, metal components of these buildings have high thermal conductivity, and thus it is difficult to efficiently and effectively control temperatures within such metal buildings. Heating and cooling costs can be relatively high.

Conventional ceiling insulation in metal buildings involves placing a layer of insulating material over the top of the roof purlins, with the roof deck then being attached over the insulation to the purlins. The roof deck squeezes the insulation above each purlin thereby reducing the R-value and increasing energy loss. The insulation is installed from the outside of the building, and involves relatively costly labor which can also be dangerous and difficult in windy or wet conditions.

Applicant's patent U.S. Pat. No. 6,330,779 overcame many of the problems associated with conventional insulated ceilings for metal buildings by attaching a substantially rigid insulated sheet to the bottom flange of the purlins and then filling the space between the insulation board and the roofing deck with insulation. However, the insulation board was attached to the purlins using penetrating fasteners, such as self tapping screws. This method of attaching the insulation board to the purlin is time consuming and therefore costly. Also, the metal screws provide thermal conductivity through the metal purlins and metal roof decking, thereby reducing the R-value and increasing energy costs.

Applicant's patent U.S. Pat. No. 7,107,632 eliminated the screws of its earlier '779 patent, through the use of a clip having support members for receiving the side edges of the ceiling panels, without penetrating screw or pins. This prior art system works fine for rigid ceiling panels, but will not accommodate light weight ceiling fabric, such as plastic or vinyl, which may be used to support blown-in insulation.

Therefore, a primary objective of the present invention is the provision of an improved purlin clip.

Another objective of the present invention is the provision of a purlin clip having an integrally formed pin for piercing a fabric ceiling membrane.

A further objective of the present invention is the provision of an improved purlin clip which can be quickly, easily and securely mounted on a roof purlin for use with blow-in insulation.

Still another objective of the present invention is the provision of an improved purlin clip having a one-piece construction with a pin to penetrate the ceiling membrane.

Yet another objective of the present invention is the provision of an improved purlin clip which is economical to manufacture, and durable and safe in use.

These and other objectives will become apparent from the following description of the invention.

BRIEF SUMMARY OF THE INVENTION

The improved purlin clip of the present invention includes a lower leg and an upper arm defining a channel to receive the horizontal leg of a roof purlin. An integral pin is stamped or formed from the lower leg of the clip, and extends downwardly, such that the clip body and pin have a one-piece construction. The pin includes barbs or teeth and a pointed tip. The pin is adapted to pierce a fabric ceiling membrane, such as vinyl or plastic. A cap is press-fit onto the pin so as to be frictionally retained by the barbs, and so as to support and retain the ceiling membrane on the clip. The cap encloses the pin to minimize or eliminate thermal conductivity or shorting, as well as frost or condensation accumulation on the pin. After the ceiling membrane is secured to a plurality of clips across the ceiling, insulation can be easily blown in between the membrane and the roof deck.

DETAILED DESCRIPTION OF THE PREFERRED EMBODIMENTS

Figure 1:
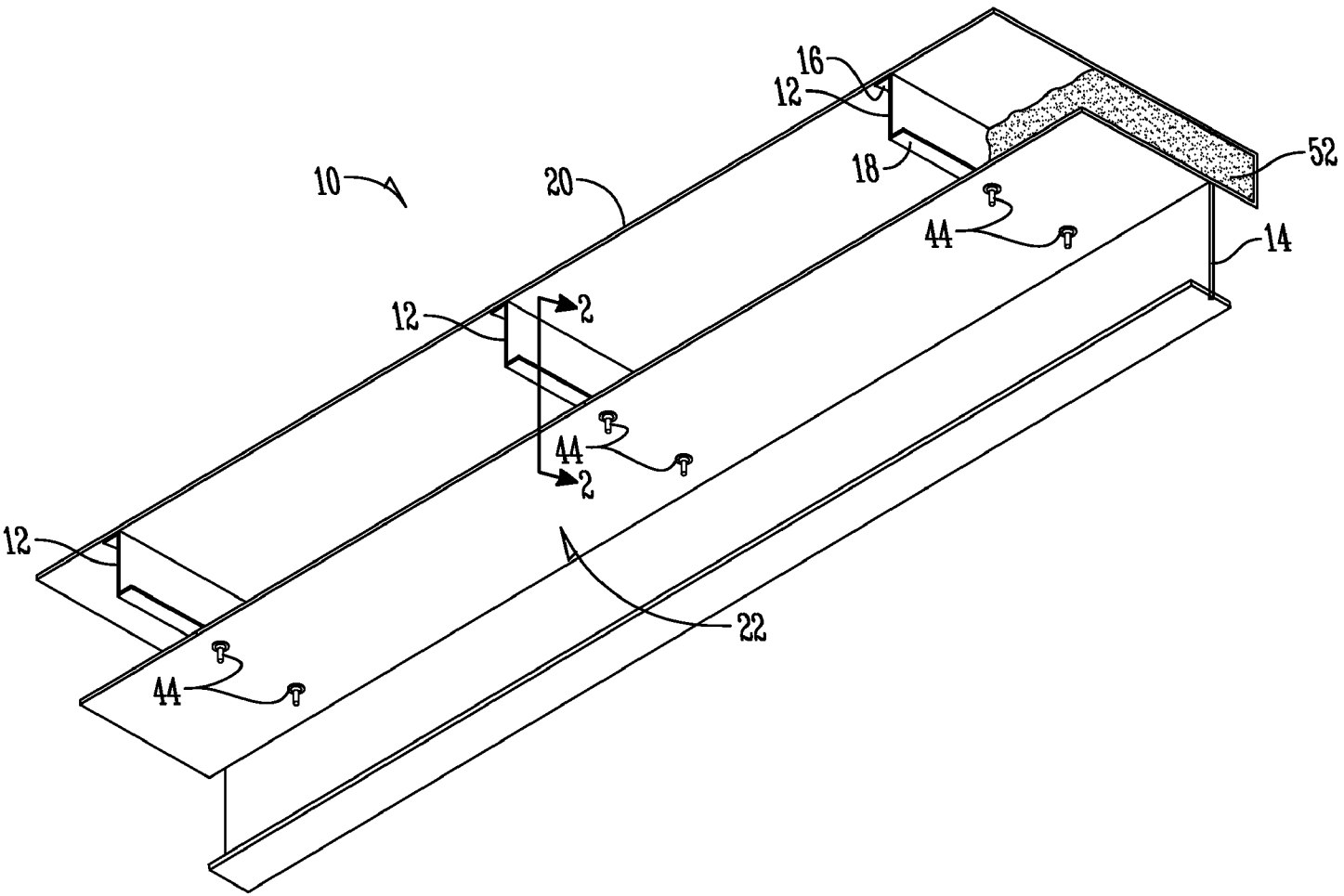
FIG. 1 is a perspective view of a metal building ceiling having blow-in insulation using the purlin clips and ceiling membrane according to the present invention.
Figure 2:
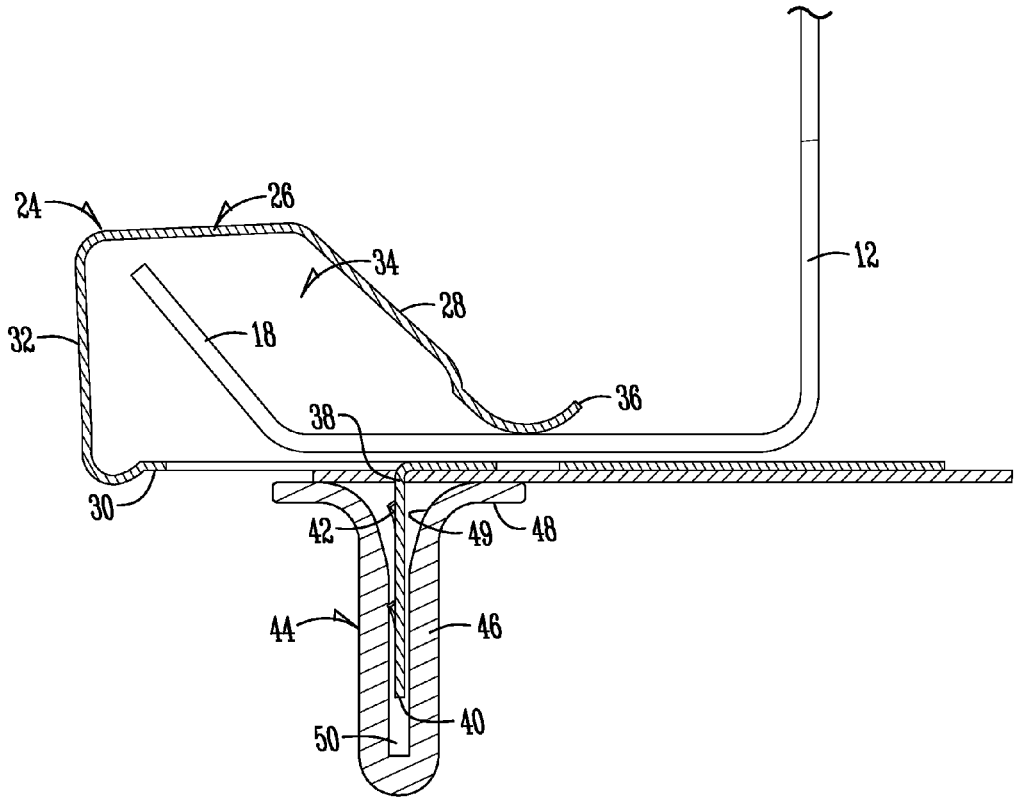
FIG. 2 is a sectional view taken along lines 2-2 of FIG. 1, prior to addition of insulation.
Figure 3:
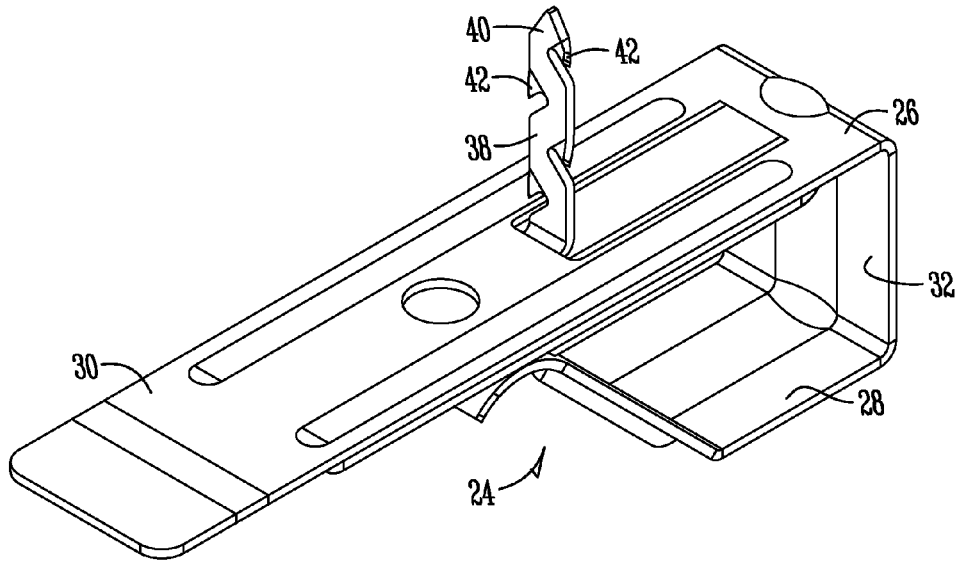
FIG. 3 is a bottom perspective view of the improved purlin clip of the present invention.
Figure 4:
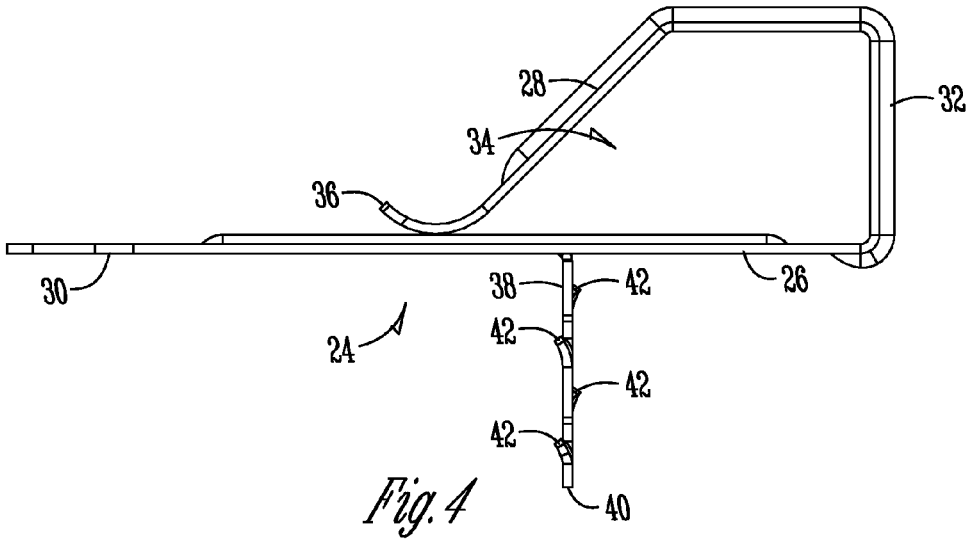
FIG. 4 is a side elevation view of the purlin clip of the present invention.
Figure 5:
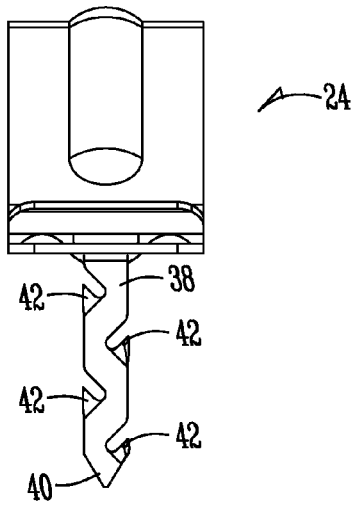
FIG. 5 is an end elevation view of the purlin clip of the present invention.
Figure 6:
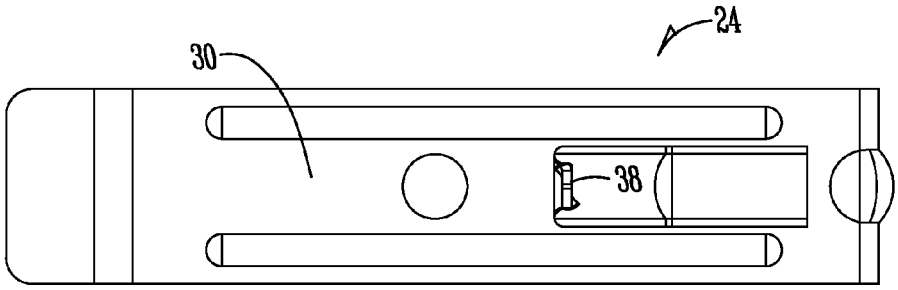
FIG. 6 is a bottom plan view of the purlin clip of the present invention.

In FIG. 1, reference numeral 10 generally designates the insulated roof and ceiling structure of a metal building. The ceiling 10 includes a plurality of spaced apart framing members 12, commonly known as purlins, supported on I-beams or other structural framing 14. The purlins 12 are spaced apart and parallel to one another and generally have a Z-profile, as seen in FIG. 1, or a C-profile. Each purlin 12 includes an upper flange 16 and a lower flange 18. A roof deck 20 is attached to the upper flange 16 of the purlins 12 using conventional fasteners (not shown). The deck 20 may be flat or corrugated metal. The purlins 12, I-beams 14, and roof deck 20 are conventionally constructed. The lower ceiling is a fabric sheet or membrane 22. The membrane 22 is secured to the lower flange 18 of the purlins 12 using a plurality of the improved purlin clips 24 of the present invention. In the industry, the ceiling membrane is known as a scrim, and is preferably a tear-resistant material. For example, light weight parachute-type material having reinforcing fibers allows the material to be punctured without subsequent tearing or ripping. Vinyl, plastic or rubber based membranes may also be used.

Each purlin clip 24 includes a body 26 formed with an upper arm 28, a lower leg 30 and an interconnecting web 32. The arm 28, the leg 30, and the web 32 form a channel 34 for receipt of the lower purlin flange. The arm 28 may have a flared or curved end 36 to facilitate receipt of the clip 24 over the flange 18 of the purlin 12.

Each clip 24 also includes an integrally formed pin 38 which is stamped or punched from the lower leg 30 of the body 26. Thus, the clip 24 has a one-piece construction including both the body 26 and the pin 38. The pin 38 includes a pointed tip 40 and a plurality of teeth or barbs 42 along the length of the pin 38. The pin 38 extends downwardly at 90° from the leg 30 of the clip 24. Because of the integral formation of the pin 38 from the body 26 of the clip 24, the pin is substantially rigid. The pin 38 is adapted to pierce or penetrate the ceiling membrane 22.

Figure 7:
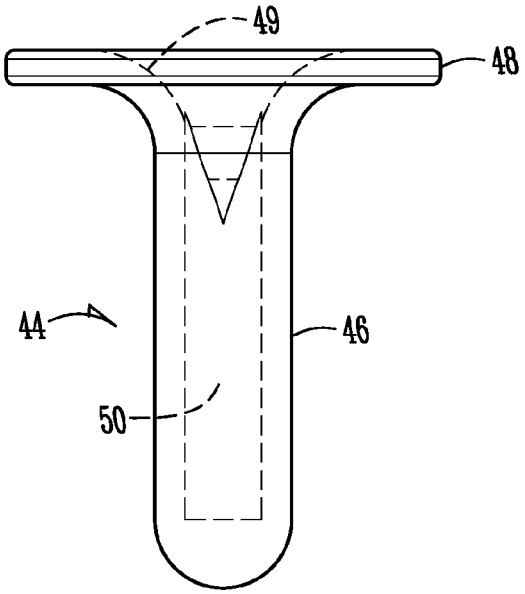
FIG. 7 is a side elevation view of the purlin clip cap of the present invention.
Figure 8:
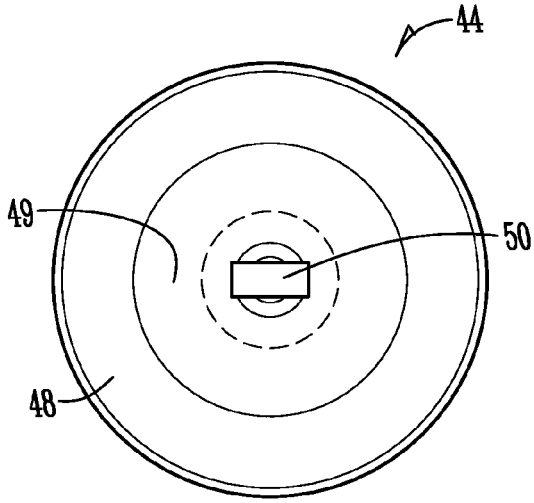
FIG. 8 is an end view of the purlin clip cap.
Figure 9:
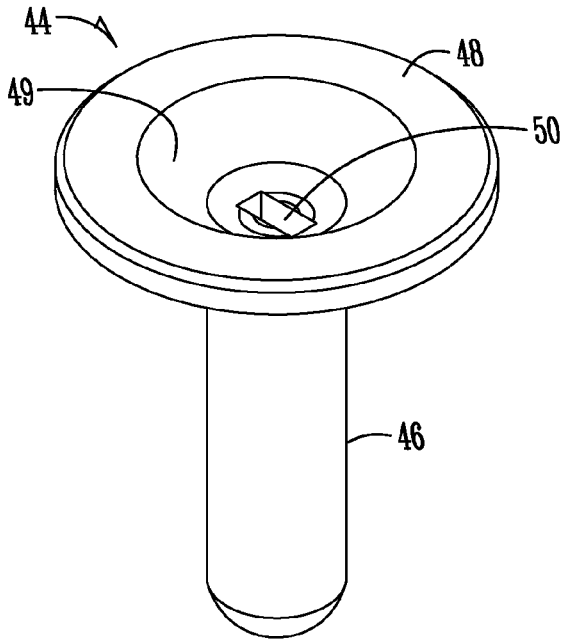
FIG. 9 is a perspective of the purlin clip cap.

After the pin 38 is punched through the membrane 22, a clip cap 44 is press fit onto the pin 38. As seen in FIGS. 7-9, the cap 44 includes a cylindrical body 46 and an enlarged upper end or head 48. The cap 44 includes a tapered or sloped upper entry 49, and a rectangular slot 50 for mating engagement with the pin 38. The barbs 42 of the pin 38 retain the cap 44 on the pin 38 after the cap is pushed upwardly onto the pin by an installer. The elongated body 46 of the cap 44 allows the installer to easily grasp the cap for quick mounting of the cap onto the pin 38. The funnel shape of the cap entry 49 quickly and easily aligns the slot 50 with the pointed tip 40 of the pin 38. The cap 44 encloses the pin 38, and thereby reduces or eliminates thermal conductivity through the metal pin and prevents frost or condensation build-up on the metal pin 38.

The enlarged head 48 of the cap 44 engages and supports the ceiling membrane 22, and presses the membrane between the cap 44 and the clip 24. The clips 24 and caps 44 allow the membrane 22 to support blown-in insulation 52 without tearing of the membrane 22 adjacent the clip pins 38.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An insulting ceiling for a building having spaced apart purlins with upper and lower flanges, comprising:

a ceiling membrane to support blow in insulation; and a plurality of purlin clips mountable on the purlins to support the ceiling membrane; each purlin clip comprising:

a clip body having an upper arm and a lower leg forming a channel there between to receive the lower flange of one of the purlins so as to mount the clip on the purlin;

the lower leg extending beyond the upper arm;

an elongated pin extending downwardly from the lower leg of the clip body to punch through the ceiling membrane so as to extended beyond the membrane;

a cap to retentively mount on the pin below the membrane;

the cap having a body extending along the length of the pin so as to enclose the pin below the membrane to eliminate thermal conductivity, and an enlarged upper end to support the membrane; and the clip body and the pin having a one-piece construction.

2. The ceiling of claim 1 wherein the pin has a plurality of barbs along the pin and the cap body has a rectangular opening with sideswalls engageable by the barbs for retaining the cap on the pin.

3. The ceiling of claim 2 wherein the barbs are integrally formed on the pin.

4. The ceiling of claim 2 wherein the pin has a planar profile, and the barbs extend beyond the planar profile in opposite directions.

5. The ceiling of claim 1 wherein the pin is integrally formed from the lower leg of the body.

6. The ceiling of claim 1 wherein the pin extends 90° from the lower leg of the body.

7. The ceiling of claim 1 wherein the cap is retained by friction on the pin.

8. The ceiling of claim 1 wherein the pin does not extend above the lower leg of the body.

9. The ceiling of claim 1 wherein the upper end of the cap is adjacent the lower clip leg when the cap is mounted on the pin.

10. An improved insulated ceiling, including a plurality of spaced apart purlins each having a plurality of purlin clips mounted thereon, each clip having an upper arm and a lower leg defining a channel to receive a flange of one of the purlings, the improvement comprising:

a pin integrally formed from the lower leg on each clip and extending downwardly;

a flexible membrane pierced by the pins so that the pins extended beyond the membrane;

a cap press fit onto each pin for fully enclosing the pin below the membrane to eliminate thermal conductivity and to retain the membrane in engagement with the lower leg of each clip; and insulation supported by the membrane and between the purlins.

11. The improved ceiling of claim 10 wherein each pin has barbs integrally formed along a length for frictionally retaining the cap, each pin having a rectangular cross section, and the cap having a rectangular opening with sidewalls to frictionally engage the barbs.

12. The improved ceiling of claim 11 wherein the pin has a planar profile, and the barbs extend beyond the planar profile in opposite directions.

13. The improved ceiling of claim 10 wherein the pin does not extend above the lower leg of the body.

14. The improved ceiling of claim 10 wherein the pin is metal and the cap is plastic.

15. The improved ceiling of claim 10 wherein the cap has a funnel-shaped entry for the pin.

16. The improved ceiling of claim 10 wherein the cap has a cylindrical body to surround the pin and an enlarged upper end to support the membrane.

17. The improved ceiling of claim 16 wherein the upper end of the cap is adjacent the lower clip leg when the cap is mounted on the pin.

18. The improved ceiling of claim 10 wherein the lower leg of each clip is longer than the upper arm of each clip.

* * * * *